US011056048B2

(12) United States Patent
Nam

(10) Patent No.: US 11,056,048 B2
(45) Date of Patent: Jul. 6, 2021

(54) PIXEL AND DISPLAY DEVICE HAVING THE SAME

(71) Applicant: SAMSUNG DISPLAY CO., LTD., Yongin-si (KR)

(72) Inventor: Hui Nam, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/816,534

(22) Filed: Mar. 12, 2020

(65) Prior Publication Data

US 2020/0372854 A1 Nov. 26, 2020

(30) Foreign Application Priority Data

May 20, 2019 (KR) ..... 10-2019-0058994

(51) Int. Cl.
*G09G 3/32* (2016.01)

(52) U.S. Cl.
CPC ..... *G09G 3/32* (2013.01); *G09G 2300/0809* (2013.01); *G09G 2310/06* (2013.01); *G09G 2320/0252* (2013.01)

(58) Field of Classification Search
CPC ..... G09G 3/32
See application file for complete search history.

(56) References Cited

U.S. PATENT DOCUMENTS 8,912,989 B2 12/2014 Chung et al.

FOREIGN PATENT DOCUMENTS

| | | |
|---|---|---|
| KR | 10-2011-0078387 | 7/2011 |
| KR | 10-1717986 | 3/2017 |
| KR | 10-1849582 | 4/2018 |

*Primary Examiner* — Gustavo Polo
(74) *Attorney, Agent, or Firm* — F. Chau & Associates, LLC

(57) ABSTRACT

A pixel includes a light emitting device, a first transistor for controlling an amount of current flowing from a first power source to a second power source via the light emitting device, corresponding to a voltage applied to a first node, a second transistor coupled between a data line and a second node, and including a gate electrode coupled to a first scan line, a third transistor coupled between the second node and a first electrode of the first transistor, and including a gate electrode coupled to a second scan line, a first capacitor coupled between the first power source and the second node, and a second capacitor coupled between the first node and the second node.

18 Claims, 9 Drawing Sheets

PIXEL AND DISPLAY DEVICE HAVING THE SAME

CROSS-REFERENCE TO RELATED APPLICATION

The present application claims priority under 35 U.S.C. § 119(a) to Korean Patent Application No. 10-2019-0058994, filed on May 20, 2019 in the Korean Intellectual Property Office, the disclosure of which is incorporated by reference herein in its entirety.

TECHNICAL FIELD

Exemplary embodiments of the inventive concept generally relate to a display device, and more particularly, to a pixel and a display device having the same.

DISCUSSION OF RELATED ART

A display device displays an image by using pixels emitting lights of various colors (e.g., red, green, and blue).

The display device includes pixels coupled to data lines and scan lines. Each of the pixels generally includes a light emitting device and a driving transistor for controlling an amount of current flowing through the light emitting device. The driving transistor controls an amount of current flowing from a first power source to a second power source via the light emitting device, corresponding to a data signal. The light emitting device generates light with a predetermined luminance corresponding to the amount of current from the driving transistor.

High-speed driving of the display device is required so as to implement a high-resolution or three-dimensional (3D) image. In addition, studies have been conducted to sufficiently secure a time for compensating for a threshold voltage of the driving transistor so as to ensure image quality of a certain level or more under high-speed driving.

SUMMARY

According to an exemplary embodiment of the inventive concept, a pixel includes a light emitting device, a first transistor configured to control an amount of current flowing from a first power source to a second power source via the light emitting device, corresponding to a voltage applied to a first node, a second transistor coupled between a data line and a second node, and including a gate electrode coupled to a first scan line, a third transistor coupled between the second node and a first electrode of the first transistor, and including a gate electrode coupled to a second scan line, a first capacitor coupled between the first power source and the second node, and a second capacitor coupled between the first node and the second node.

The pixel may further include a fourth transistor coupled between the first node and a third power source, and including a gate electrode coupled to the second scan line, and a fifth transistor coupled between a second electrode of the first transistor and the third power source, and including a gate electrode coupled to the second scan line.

The pixel may further include a sixth transistor coupled between the first power source and the first electrode of the first transistor, and including a gate electrode coupled to an emission control line.

The sixth transistor may be turned off after the third to fifth transistors are turned on.

A first time at which a scan signal supplied to the second scan line is changed from a gate-off level to a gate-on level may be earlier than a second time at which an emission control signal supplied to the emission control line is changed from the gate-on level to the gate-off level.

A portion of the gate-on level of the scan signal supplied to the second scan line may overlap with a period in which the emission control signal has the gate-on level.

A width of a gate-on level of the scan signal supplied to the second scan line may be wider than that of a scan signal supplied to the first scan line.

The third to fifth transistors may be turned on by a scan signal supplied to the second scan line, and the first transistor may be coupled in a source follower state.

When the third to fifth transistors are turned on by a scan signal supplied to the second scan line, a voltage corresponding to a threshold voltage of the first transistor may be stored in the second capacitor.

The pixel may further include a fourth transistor coupled between the first node and a third power source, and including a gate electrode coupled to the second scan line, a fifth transistor coupled between a second electrode of the first transistor and the first node, and including a gate electrode coupled to the second scan line, and a sixth transistor coupled between the first power source and the first electrode of the first transistor, and including a gate electrode coupled to an emission control line.

The pixel may further include a fourth transistor coupled between the first node and a second electrode of the first transistor, and including a gate electrode coupled to the second scan line, a fifth transistor coupled between the second electrode of the first transistor and a third power source, and including a gate electrode coupled to the second scan line, and a sixth transistor coupled between the first power source and the first electrode of the first transistor, and including a gate electrode coupled to an emission control line.

According to an exemplary embodiment of the inventive concept, a display device includes a display panel including a plurality of pixels, a scan driver configured to supply a scan signal to the plurality of pixels through scan lines, an emission driver configured to supply an emission control signal to the plurality of pixels through emission control lines, and a data driver configured to supply a data signal to the plurality of pixels through data lines. A first pixel disposed on an ith (where i is a natural number) pixel row among the plurality of pixels includes a light emitting device, a first transistor configured to control an amount of current flowing from a first power source to a second power source via the light emitting device, corresponding to a voltage applied to a first node, a second transistor coupled between a data line and a second node, and including a gate electrode coupled to a first scan line of the ith pixel row, a third transistor coupled between the second node and a first electrode of the first transistor, and including a gate electrode coupled to a second scan line of the ith pixel row, a first capacitor coupled between the first power source and the second node, and a second capacitor coupled between the first node and the second node.

The first pixel may further include a fourth transistor coupled between the first node and a third power source, and including a gate electrode coupled to the second scan line, and a fifth transistor coupled between a second electrode of the first transistor and the third power source, and including a gate electrode coupled to the second scan line.

The first pixel may further include a sixth transistor coupled between the first power source and the first electrode of the first transistor, and including a gate electrode coupled to an emission control line of the ith pixel row.

The third to fifth transistors may be turned on by a scan signal supplied to the second scan line, and the first transistor may be coupled in a source follower state.

The sixth transistor may be turned off after the third to fifth transistors are turned on.

The scan driver may supply the scan signal to the second scan line such that a portion of a gate-on level of the scan signal supplied to the second scan line overlaps with a period in which the emission control signal supplied to the emission control line of the ith pixel row has a gate-on level.

The scan driver may include a first scan driver configured to supply a first scan signal to the first scan line, and a second scan driver configured to supply a second scan signal to the second scan line.

A width of a gate-on level of the second scan signal may be wider than that of the first scan signal.

The first scan driver may output a gate-on level of the first scan signal after the second scan driver outputs a gate-on level of the second scan signal, and the gate-on level of the first scan signal and the gate-on level of the second scan signal may not overlap with each other.

BRIEF DESCRIPTION OF THE DRAWINGS

The above and other features of the inventive concept will be more fully understood by describing in detail exemplary embodiments thereof with reference to the accompanying drawings.

DETAILED DESCRIPTION OF THE EMBODIMENTS

Figure 1:
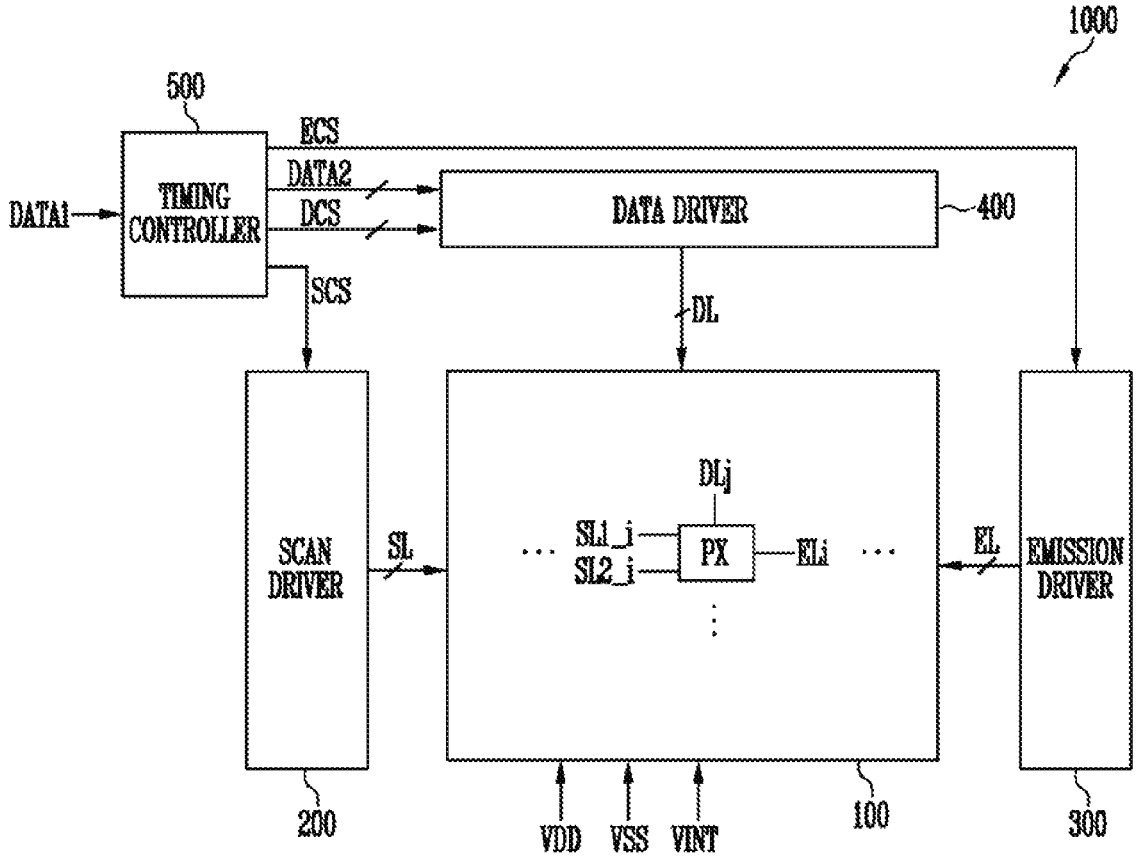
FIG. 1 is a block diagram illustrating a display device according to an exemplary embodiment of the inventive concept.

Exemplary embodiments of the inventive concept provide a pixel in which a timing at which a threshold voltage of a driving transistor is compensated is separated from that at which data is written.

Exemplary embodiments of the inventive concept also provide a display device including the pixel.

Hereinafter, exemplary embodiments of the inventive concept will be described in more detail with reference to the accompanying drawings. Like reference numerals may refer to like elements throughout this application.

In the drawings, dimensions may be exaggerated for clarity of illustration. It will be understood that when an element is referred to as being "between" two elements, it can be the only element between the two elements, or one or more intervening elements may also be present.

FIG. 1 is a block diagram illustrating a display device according to an exemplary embodiment of the inventive concept.

Referring to FIG. 1, a display device 1000 may include a display panel 100, a scan driver 200, an emission driver 300, a data driver 400, and a timing controller 500.

In an exemplary embodiment of the inventive concept, the display device 1000 may further include a power supply configured to supply a voltage of a first power source VDD, a voltage of a second power source VSS, and a voltage of a third power source VINT to the display panel 100. The power supply may provide a low power source and a high power source, which determine a gate-on level and a gate-off level of a scan signal and/or an emission control signal, to the scan driver 200 and/or the emission driver 300. The low power source may have a voltage level lower than that of the high power source. However, this is merely illustrative, and at least one of the first power source VDD, the second power source VSS, the third power source VINT, the low power source, and the high power source may be supplied from the timing controller 500 or the data driver 400.

In exemplary embodiments of the inventive concept, the first power source VDD and the second power source VSS may generate voltages for driving a light emitting device LED. In an exemplary embodiment of the inventive concept, the voltage of the second power source VSS may be lower than that of the first power source VDD. For example, the voltage of the first power source VDD may be a positive voltage, and the voltage of the second power source VSS may be a negative voltage.

The third power source VINT may be an initialization power source for initializing a pixel PX. For example, a driving transistor and/or a light emitting device, included in the pixel PX, may be initialized by the voltage of the third power source VINT. The voltage of the third power source VINT may be a negative voltage.

The display panel 100 may include a plurality of scan lines SL, a plurality of emission control lines EL, and a plurality of data lines DL, and include a plurality of pixels PX respectively coupled to the scan lines SL, the emission control lines EL, and the data lines DL. In an exemplary embodiment of the inventive concept, the pixel PX disposed on an ith row (e.g., an ith pixel row) and a jth column (e.g., a jth pixel column) (where i and j are natural numbers) may be coupled to a first scan line SL1_*i* corresponding to the ith pixel row, a second scan line SL2_*i* corresponding to the ith pixel row, an emission control line ELi corresponding to the ith pixel row, and a data line DLj corresponding to the jth pixel column.

The timing controller 500 may generate a first control signal SCS, a second control signal ECS, and a third control signal DCS, corresponding to synchronization signals supplied from the outside. The first control signal SCS may be supplied to the scan driver 200, the second control signal ECS may be supplied to the emission driver 300, and the third control signal DCS may be supplied to the data driver 400. Additionally, the timing controller 500 may convert input image data DATA1 supplied from the outside into image data DATA2, and supply the image data DATA2 to the data driver 400.

A scan start pulse and clock signals may be included in the first control signal SCS. The scan start pulse may control a first timing of a scan signal. The clock signals may be used to shift the scan start pulse.

An emission control start pulse and clock signals may be included in the second control signal ECS. The emission control start pulse may control a first timing of an emission control signal. The clock signals may be used to shift the emission control start pulse.

A source start pulse and clock signals may be included in the third control signal DCS. The source start pulse may control a sampling start time of data. The clock signals may be used to control a sampling operation.

The scan driver 200 may receive the first control signal SCS from the timing controller 500, and supply a scan signal to the scan lines SL, based on the first control signal SCS. For example, the scan driver 200 may sequentially the scan signal to the scan lines SL. When the scan signal is sequentially supplied, the pixels PX may be selected in units of horizontal lines (or units of pixel rows).

The scan signal may be set to a gate-on level (e.g., a low voltage). A transistor that is included in the pixel PX and receives the scan signal may be set to a turn-on state when the scan signal is supplied.

The emission driver 300 may receive the second control signal ECS from the timing controller 500, and supply an emission control signal to the emission control lines EL, based on the second control signal ECS. For example, the emission driver 300 may sequentially supply the emission control signal to the emission control lines EL.

The emission control signal may be set to a gate-on level (e.g., a low voltage). A transistor that is included in the pixel PX and receives the emission control signal may be turned on when the emission control signal is supplied, and be set to a turn-off state in other cases.

The emission control signal is used to control emission times of the pixels PX. The emission control signal may be set to have a width wider than that of the scan signal.

In an exemplary embodiment of the inventive concept, the scan driver 200 may supply a scan signal to the second scan line SL2_*i* such that a portion of the scan signal supplied to the second scan line SL2_*i* overlaps with a period in which an emission control signal supplied to the emission control line ELi of the ith pixel row has a gate-on level. The scan signal may be supplied to the first scan line SL1_*i* of the ith pixel row after the scan signal is supplied to the second scan line SL2_*i* of the ith pixel row.

Each of the scan driver 200 and the emission driver 300 may be mounted on a substrate through a thin film process. In addition, the scan driver 200 may be located at both sides of the display panel 100. The emission driver 300 may also be located at both sides of the display panel 100.

The data driver 400 may receive the third control signal DCS and the image data DATA2 from the timing controller 500. The data driver 400 may supply a data signal to the data lines DL, corresponding to the third control signal DCS. The data signal supplied to the data lines DL may be supplied to pixels PX selected by a scan signal. The data driver 400 may supply the data signal to the data lines DL to be in synchronization with the scan signal.

Figure 2:
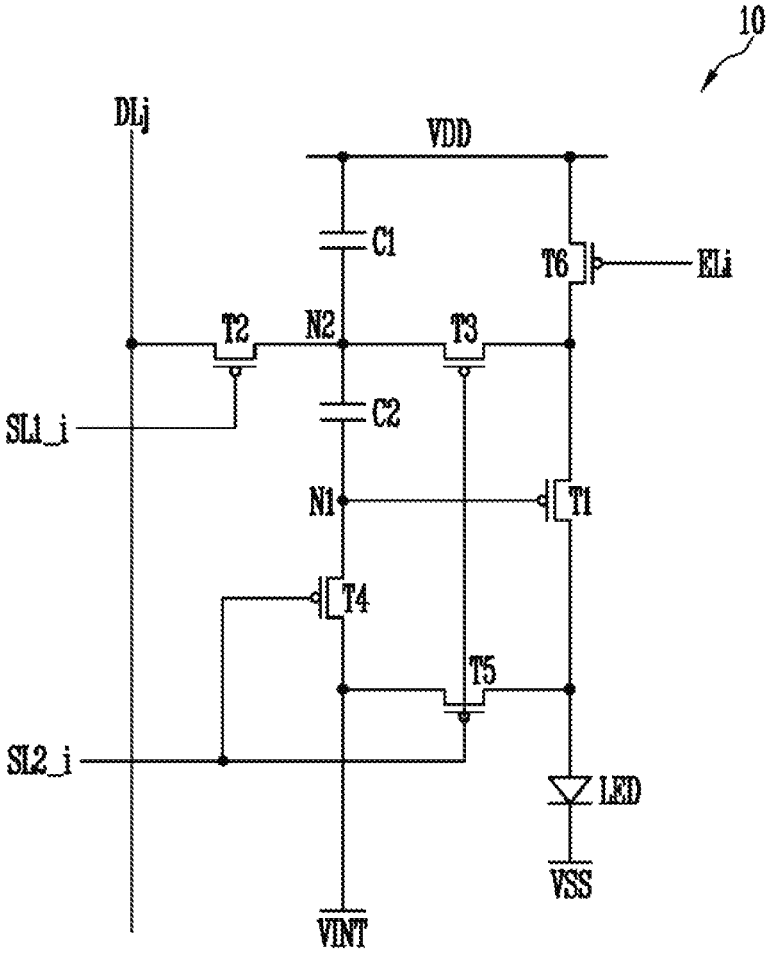
FIG. 2 is a circuit diagram illustrating a pixel according to an exemplary embodiment of the inventive concept.

FIG. 2 is a circuit diagram illustrating a pixel according to an exemplary embodiment of the inventive concept.

For convenience of description, a pixel 10 that is located on an ith horizontal line (or ith pixel row) and is coupled to a jth data line DLj is illustrated in FIG. 2. Hereinafter, a first scan line of the ith pixel row is referred to as the first scan line SL1_*i*, a second scan line of the ith pixel row is referred to as the second scan line SL2_*i*, an emission control line of the ith pixel row is referred to as the emission control line ELi, and the jth data line is referred to as the data line DLj.

In exemplary embodiments of the inventive concept, the second scan line SL2_*i* may supply a scan signal identical to that supplied to a first scan line (e.g., SL1_(i−2)) coupled to an (i−2)th pixel row.

Referring to FIG. 2, the pixel 10 may include a light emitting device LED, first to sixth transistors T1 to T6, a first capacitor C1, and a second capacitor C2.

A first electrode of the light emitting device LED may be coupled to a second electrode (e.g., a drain electrode) of the first transistor T1, and a second electrode of the light emitting device LED may be coupled to the second power source VSS. The light emitting device LED may generate light with a predetermined luminance corresponding to an amount of current (driving current) supplied from the first transistor T1. In an exemplary embodiment of the inventive concept, the light emitting device LED may be an organic light emitting diode including an organic emitting layer. The first electrode of the light emitting device LED may be an anode electrode, and the second electrode of the light emitting device LED may be a cathode electrode. On the contrary, the first electrode of the light emitting device LED may be the cathode electrode, and the second electrode of the light emitting device LED may be the anode electrode.

In an exemplary embodiment of the inventive concept, the light emitting device LED may be an inorganic light emitting device including an inorganic material. Alternatively, the light emitting device LED may have a form in which a plurality of inorganic light emitting devices are coupled in parallel and/or series between the second power source VSS and the second electrode of the first transistor T1.

The first transistor T1 may be electrically coupled between the first power source VDD and the first electrode of the light emitting device LED. The first transistor T1 may generate a driving current and provide the driving current to the light emitting device LED. A gate electrode of the first transistor T1 may be coupled to a first node N1. The first transistor T1 serves as a driving transistor of the pixel 10. The first transistor T1 may control an amount of current flowing from the first power source VDD to the second power source VSS via the light emitting device LED, corresponding to a voltage applied to the first node N1.

The second transistor T2 may be coupled between the data line DLj and a second node N2. The second transistor T2 may include a gate electrode receiving a scan signal. For example, the gate electrode of the second transistor T2 may be coupled to the first scan line SL1_*i*. The second transistor T2 may be turned on when a scan signal is supplied to the first scan line SL1_*i*, to electrically couple the data line DLj and the second node N2 to each other. Therefore, a data voltage (or data signal) may be transferred to the second node N2.

The third transistor T3 may be coupled between the second node N2 and a first electrode (e.g., a source electrode) of the first transistor T1. The third transistor T3 may include a gate electrode receiving a scan signal. For example, the gate electrode of the third transistor T3 may be coupled to the second scan line SL2_*i*. The third transistor T3 may be turned on when a scan signal is supplied to the second scan line SL2_*i*, to electrically couple the second node N2 and the first electrode of the first transistor T1 to each other. Therefore, the data voltage (or data signal) may be transferred to the second node N2.

The first capacitor C1 may be coupled between the first power source VDD and the second node N2. The first capacitor C1 may store a voltage corresponding to a difference between a voltage of the first power source VDD and the data voltage.

The second capacitor C2 may be coupled between the second node N2 and the first node N1. The second capacitor C2 may store a voltage corresponding to a threshold voltage of the first transistor T1.

When the second transistor T2 is turned on and the third transistor T3 is turned off, a voltage of the first node N1 may be determined by coupling of the first and second capacitors C1 and C2. For example, when the data voltage is supplied to the second node N2, the voltage of the first node N1 may be changed to a voltage corresponding to a difference between the data voltage and the absolute value of the threshold voltage of the first transistor T1 by the coupling of the first and second capacitors C1 and C2.

The fourth transistor T4 may be coupled between the first node N1 and the third power source VINT. The fourth transistor T4 may include a gate electrode receiving a scan signal. For example, the gate electrode of the fourth transistor T4 may be coupled to the second scan line SL2_*i*. The fourth transistor T4 may be turned on when a scan signal is supplied to the second scan line SL2_*i*, to supply a voltage of the third power source VINT to the first node N1. Therefore, the first node N1, e.g., a gate voltage of the first transistor T1 may be initialized.

The fifth transistor T5 may be coupled between the second electrode of the first transistor T1 (and the first electrode of the light emitting device LED) and the third power source VINT. The fifth transistor T5 may include a gate electrode receiving a scan signal. For example, the gate electrode of the fifth transistor T5 may be coupled to the second scan line SL2_*i*. The fifth transistor T5 may be turned on when a scan signal is supplied to the second scan line SL2_*i*, to supply the voltage of the third power source VINT to the first electrode of the light emitting device LED. Therefore, the first electrode of the light emitting device LED may be initialized.

The sixth transistor T6 may be coupled between the first power source VDD and the first electrode of the first transistor T1. The sixth transistor T6 may include a gate electrode receiving an emission control signal. For example, the gate electrode of the sixth transistor T6 may be coupled to the emission control line ELi. The sixth transistor T6 may be turned on when an emission control signal is supplied to the emission control line ELi, to couple the first electrode of the first transistor T1 to the first power source VDD. Accordingly, the light emitting device LED can emit light with a luminance corresponding to the voltage of the first node N1.

When the third to fifth transistors T3 to T5 are turned on, the first transistor T1 may be coupled in a source follower state. Then, a voltage corresponding to the threshold voltage of the first transistor T1 may be stored in the second capacitor C2. In other words, the first transistor T1 is coupled in the source follower state during a predetermined period, so that the threshold voltage of the first transistor T1 can be compensated.

Subsequently, the data voltage may be written in the pixel 10 when the second transistor T2 is turned on. Accordingly, a threshold voltage compensation period and a data writing period can be separated from each other. A detailed driving method of the pixel 10 will be described with reference to FIG. 3.

Figure 3:
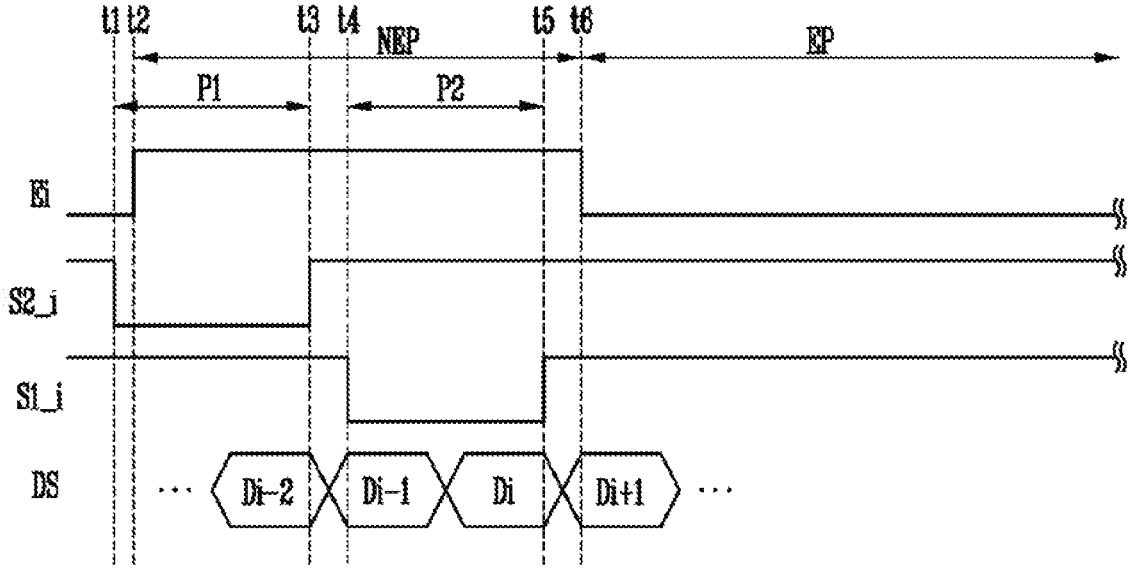
FIG. 3 is a timing diagram illustrating an operation of the pixel shown in FIG. 2 according to an exemplary embodiment of the inventive concept.

FIG. 3 is a timing diagram illustrating an operation of the pixel shown in FIG. 2 according to an exemplary embodiment of the inventive concept.

Referring to FIGS. 2 and 3, an emission control signal Ei may be supplied to the emission control line ELi, a first scan signal S1_*i* may be supplied to the first scan line SL1_*i*, and a second scan signal S2_*i* may be supplied to the second scan line SL2_*i*.

In an exemplary embodiment of the inventive concept, the first scan signal S1_*i* may be a scan signal obtained by shifting the second scan signal S2_*i*. In addition, the second scan signal S2_*i* may be identical to a first scan signal supplied to the (i−2)th pixel row.

The timing diagram shown in FIG. 3 shows a partial waveform of one frame period. The one frame period may include an emission period EP and a non-emission period NEP according to the emission control signal Ei. A period in which the emission control signal Ei has a gate-on level may be the emission period EP, and a period in which the emission control signal Ei has a gate-off level may be the non-emission period NEP.

The gate-off level may be a voltage level at which a corresponding transistor is turned off, and the gate-on level may be a voltage level at which the corresponding transistor is turned on.

At a first time t1, the second scan signal S2_*i* may be changed from the gate-off level to the gate-on level, and the third to fifth transistors T3 to T5 may be turned on. Since the emission control signal Ei has the gate-on level at the first time t1, the sixth transistor T6 is in the turn-on state. The voltage of the first power source VDD may be charged in the second node N2 during a short time between the first time t1 and a second time t2 by the turned-on third and sixth transistors T3 and T6. In other words, for the purpose of subsequent source follower driving, a portion of the second scan signal S2_*i* may overlap with a portion of the period in which the emission control signal Ei has the gate-off level, so that the voltage of the first power source VDD is charged in the second node N2.

In other words, the first time t1 may be earlier than the second time t2 at which the emission control signal Ei having the gate-on level is changed to the gate-off level. The time between the first time t1 and the second time t2 may be set short enough so as to not have great influence on emission of the pixel 10.

The second scan signal S2_*i* may maintain the gate-on level during a first period P1.

Subsequently, at the second time t2, the emission control signal Ei having the gate-on level may be changed to the gate-off level, and the sixth transistor T6 may be turned off. Accordingly, the non-emission period NEP can be started.

The third to fifth transistors T3, T4, and T5 may maintain the turn-on state during the first period P1. Therefore, the voltage of the third power source VINT may be applied to the first node N1, the second electrode of the first transistor T1, and the first electrode of the light emitting device LED. Accordingly, the gate voltage of the first transistor T1 and a voltage of the first electrode of the light emitting device LED can be initialized to the voltage of the third power source VINT.

In addition, since the sixth transistor T6 is turned off at the second time t2 in a state in which the third transistor T3 is turned on, the first transistor T1 may be entirely in the source follower state. As described above, a current may flow through the first transistor T1 due to the voltage of the third power source VINT, which is applied to the second electrode of the transistor T1. The second node N2 is charged by the current of the first transistor T1. When a gate-source voltage of the first transistor T1 reaches the threshold voltage, the current does not flow through the first transistor T1, and therefore, the voltage of the second node N2 may be constantly maintained. In other words, the voltage of the second node N2 may be a voltage (VINT+|Vth|) corresponding to the sum of the voltage of the third power source VINT and the absolute value of the threshold voltage of the first transistor. Therefore, a voltage corresponding to the threshold voltage Vth of the first transistor T1 may be stored in the second capacitor C2. In other words, the first transistor T1 may be connected in the source follower state during a predetermined period, such that the threshold voltage of the first transistor T1 is compensated.

As described above, in the first period P1, initialization and threshold voltage compensation of the pixel 10 may be performed when the third to fifth transistors T3 to T5 are turned on.

Subsequently, at a third time t3, the second scan signal S2_*i* having the gate-on level may be changed to the gate-off level, and the third to fifth transistors T3 to T5 may be turned off.

At a fourth time t4, the first scan signal S1_*i* having the gate-off level may be changed to the gate-on level. At a fifth time t5, the first scan signal S1_*i* having the gate-on level may be changed to the gate-off level. At the fourth time t4, the second transistor T2 may be turned on. The second transistor T2 may maintain the turn-on state in a second period P2 defined by the fourth and fifth times t4 and t5. A data voltage DS may be supplied to the second node N2 through the turned-on second transistor T2. Accordingly, the voltage of the second node N2 can correspond to the data voltage DS.

When the data voltage DS is supplied to the second node N2, the voltage of the first node N1 may be changed to a voltage corresponding to the difference between the data voltage DS and the threshold voltage Vth of the first transistor T1 by the coupling of the first capacitor C1 and the second capacitor C2. For example, a voltage corresponding to the difference between the voltage of the first power source VDD and the data voltage DS may be stored in the first capacitor C1, and a voltage corresponding to the difference between the data voltage DS and the threshold voltage Vth of the first transistor T1 may be stored in the second capacitor C2.

In an exemplary embodiment of the inventive concept, the first and second periods P1 and P2 may have a length of two horizontal periods 2H or more. In other words, the first and second scan signals S1_*i* and S2_*i* may have a pulse width of two horizontal periods 2H or more. Additionally, the first and second scan signals S1_*i* and S2_*i* may have substantially the same pulse width. For example, in a display having high resolution of Full HD or more, the first and second scan signals S1_*i* and S2_*i* may have a pulse width of 2 μs or more.

FIG. 3 shows the data voltage DS sequentially supplied through the data line DLj. The data voltage DS may be supplied to the data line DLj for every one horizontal period 1H. For example, during the second period P2, an (i−1)th data voltage Di−1 corresponding to an (i−1)th pixel row and an ith data voltage Di corresponding to the ith pixel row may be supplied to the data line DLj.

Since the ith data voltage Di is finally stored at the second node N2 at a time at which the second period P2 is ended, the emission luminance of the pixel 10 is not influenced by the (i−1)th data voltage Di−1. Therefore, a plurality of data voltages DS may be supplied to the pixel 10 while overlapping with the first scan signal S1_*i*.

As described above, at a fifth time t5, the first scan signal S1_*i* having the gate-on level may be changed to the gate-off level, and the second transistor T2 may be turned off. Accordingly, at the fifth time t5, the voltage of the second node N2 can correspond to the ith data voltage Di, and the voltage of the second node N2 can correspond to the difference between the ith data voltage Di and the threshold voltage Vth of the first transistor T1. In other words, a threshold voltage compensation period and a data writing period of the pixel 10 can be separated from each other.

At a sixth time t6, the emission control signal Ei having the gate-off level may be changed to the gate-on level, and the sixth transistor T6 may be turned on. Accordingly, a driving current flowing from the first transistor T1 to the light emitting device LED can be generated based on the ith data voltage Di. During the emission period EP, the light emitting device LED can emit light with a luminance corresponding to the ith data voltage Di.

As described above, in the pixel 10 according to an exemplary embodiment of the inventive concept, the threshold voltage of the first transistor T1 can be compensated using a source follower structure. Accordingly, the initialization and the threshold voltage compensation can be substantially simultaneously performed, and the threshold voltage compensation period and the data writing period can be separated from each other. Thus, a time for compensating for the threshold voltage of the pixel 10 to which high-speed driving is applied can be sufficiently secured, and image quality can be improved.

Figure 4:
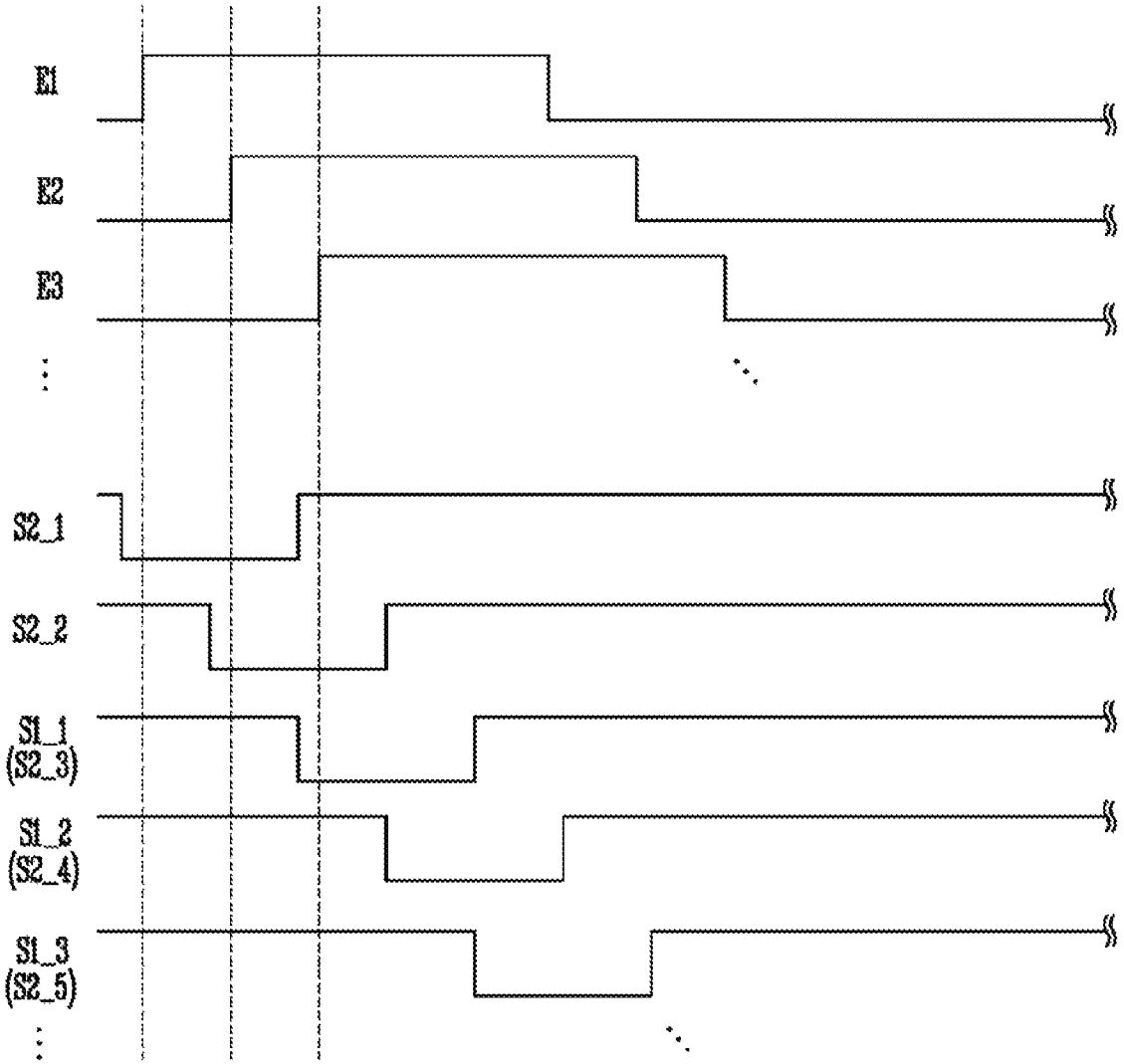
FIG. 4 is a timing diagram illustrating an operation of the display device shown in FIG. 1 according to an exemplary embodiment of the inventive concept.

FIG. 4 is a timing diagram illustrating an operation of the display device shown in FIG. 1 according to an exemplary embodiment of the inventive concept.

Referring to FIGS. 1 to 4, emission control signals E1, E2, and E3, first scan signals S1_1, S1_2, and S1_3, and second scan signals S2_1, S2_2, and S2_3 may be sequentially supplied to pixel rows.

A first emission control signal E1, a first first scan signal S1_1, and a first second scan signal S2_1 may be supplied to a first pixel row. A second emission control signal E2, a second first scan signal S1_2, and a second second scan signal S2_2 may be supplied to a second pixel row. Similarly, a third emission control signal E3, a third first scan signal S1_3, and a third second scan signal S2_3 may be supplied to a third pixel row.

In an exemplary embodiment of the inventive concept, the emission control signals E1, E2, and E3 may be shifted by about one horizontal period 1H unit to be supplied. The first scan signals S1_1, S1_2, and S1_3 may be shifted by about one horizontal period 1H unit to be supplied. The second scan signals S2_1, S2_2, and S2_3 may be shifted by about one horizontal period 1H unit to be supplied. Accordingly, portions of the first scan signals S1_1, S1_2, and S1_3 corresponding to adjacent pixel rows can overlap with one another. In addition, portions of the second scan signals S2_1, S2_2, and S2_3 corresponding to adjacent pixel rows can overlap with one another.

The first first scan signal S1_1 and the first second scan signal S2_1 do not overlap with each other. In addition, the second first scan signal S1_2 and the second second scan signal S2_2 do not overlap with each other. Similarly, the third first scan signal S1_3 and the third second scan signal S2_3 do not overlap with each other.

In an exemplary embodiment of the inventive concept, the second scan signals S2_1, S2_2, and S2_3 may respectively overlap with portions of emission periods of the emission control signals E1, E2, and E3. For example, a portion of the first second scan signal S2_1 may overlap with a portion of the period in which the first emission control signal E1 has the gate-on level.

In an exemplary embodiment of the inventive concept, a second scan signal (e.g., S2_k) supplied to a kth (where k is a natural number greater than 2) pixel row may be identical to a first scan signal (e.g., S1_(k−2)) supplied to a (k−2)th pixel row. For example, the third second scan signal S2_3 may be identical to the first first scan signal S1_1. Accordingly, one scan driver 200 can supply the first and second scan signals S1_1, S1_2, S1_3, S2_1, S2_2, and S2_3.

As described above, in the display device according to an exemplary embodiment of the inventive concept, a threshold voltage compensation period corresponding to the second scan signals S2_1, S2_1, and S2_3 and a data writing period corresponding to the first scan signals S1_1, S1_2, and S1_3 can be separated from each other. Thus, a time for threshold voltage compensation of the display device to which high-speed driving is applied can be sufficiently secured at 2 μs or more, and image quality can be improved. In addition, image quality of a high-resolution display device, a large-sized display device, a stereoscopic image display device, or the like, which require high-speed driving, can be improved.

Further, the pixel 10 is driven using a minimum number of power sources and signals, so that manufacturing cost of the display device can be reduced.

Figure 5:
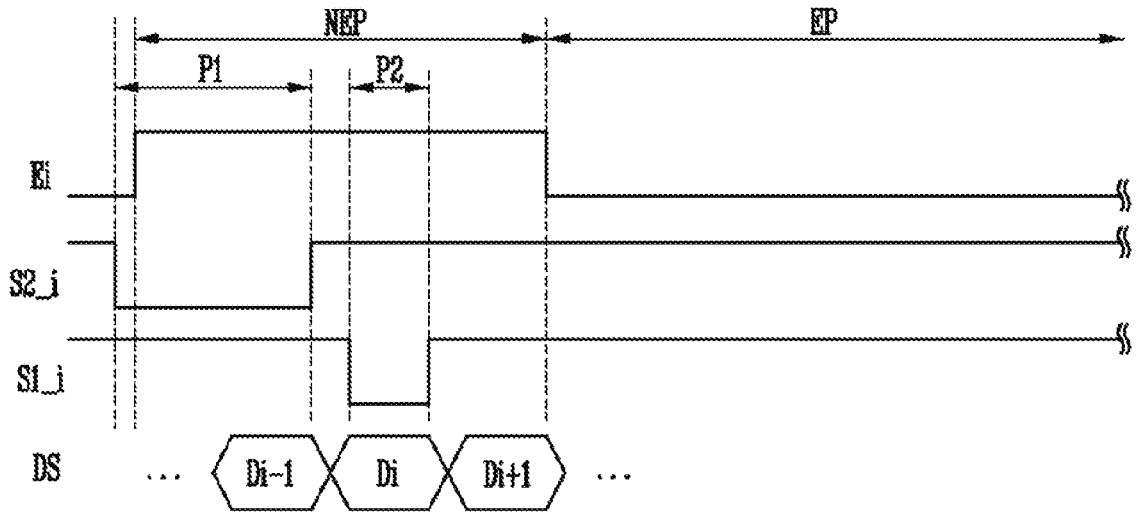
FIG. 5 is a timing diagram illustrating an operation of the pixel shown in FIG. 2 according to an exemplary embodiment of the inventive concept.

FIG. 5 is a timing diagram illustrating an operation of the pixel shown in FIG. 2 according to an exemplary embodiment of the inventive concept.

In FIG. 5, components identical to those described with reference to FIGS. 2 and 3 are designated by like reference numerals, and their overlapping descriptions will be omitted. In addition, the timing diagram shown in FIG. 5 may be substantially identical or similar to the driving method of the pixel shown in FIG. 3, except for a width (pulse width) of the first scan signal S1_*i*.

Referring to FIGS. 2 and 5, the emission control signal Ei may be supplied to the emission control line ELi, and the first scan signal S1_*i* may be supplied to the first scan line SL1_*i*, and the second scan signal S2_*i* may be supplied to the second scan line SL2_*i*.

A width of the first scan signal S1_*i* corresponding to the second period P2 may be narrower than that of the second scan signal S2_*i* corresponding to the first period P1. In other words, only the ith data voltage Di may be supplied to the second node N2 of the pixel 10 in the second period P2 in which the data voltage DS is written. For example, the width of the first scan signal S1_*i* may be half of the width of the second scan signal S2_*i* corresponding to the first period P1. However, this is merely illustrative, and the width of the first scan signal S1_*i* is not limited thereto.

Thus, unintended influence caused by the (i−1)th data voltage Di−1, etc. is excluded, and unnecessary voltage fluctuation of the first and second nodes N1 and N2 can be prevented.

Figure 6:
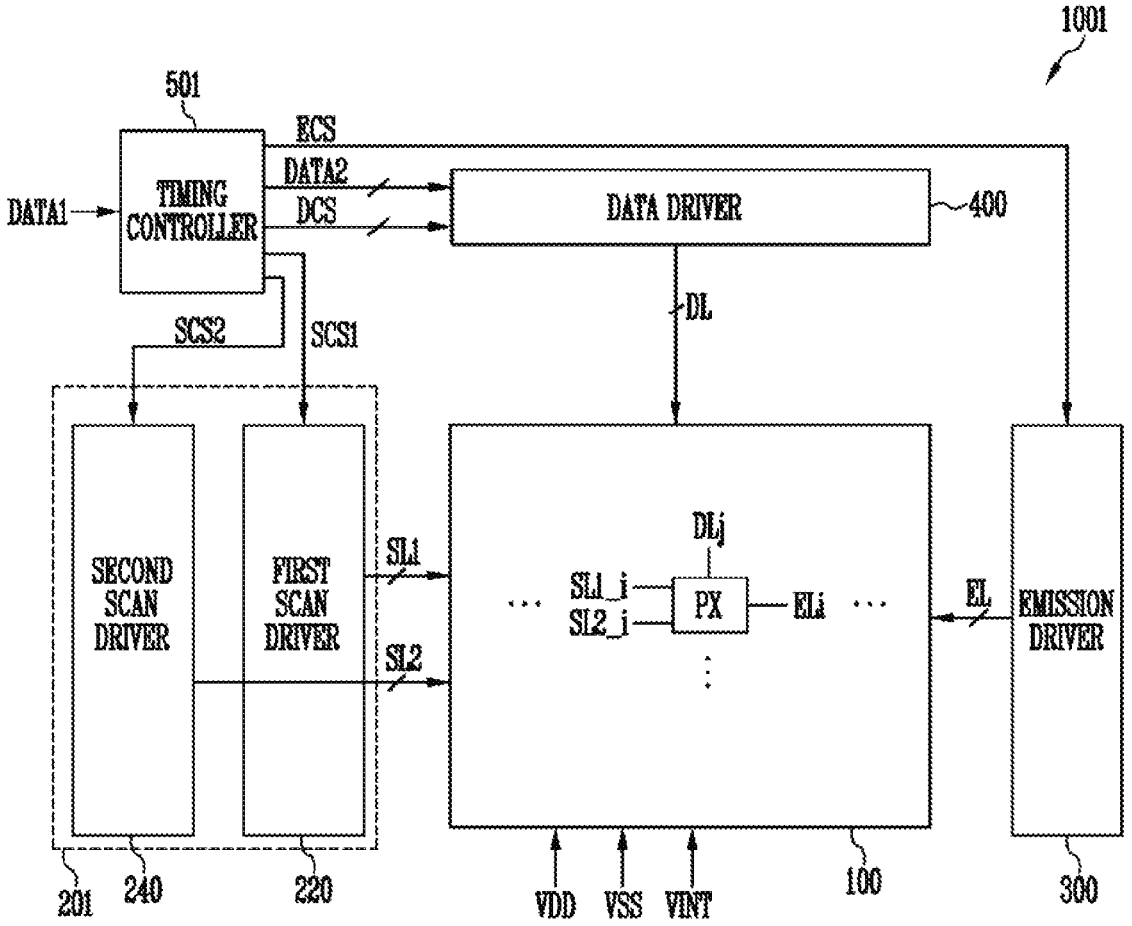
FIG. 6 is a block diagram illustrating a display device according to an exemplary embodiment of the inventive concept.

FIG. 6 is a block diagram illustrating a display device according to an exemplary embodiment of the inventive concept.

FIG. 6 shows a configuration of the display device for outputting scan signals.

In FIG. 6, components identical to those described with reference to FIG. 1 are designated by like reference numerals, and their overlapping descriptions will be omitted. In addition, the display device shown in FIG. 6 may have a configuration substantially identical or similar to that of the display device shown in FIG. 1, except for the configuration of a scan driver.

Referring to FIGS. 5 and 6, a display device 1001 may include the display panel 100, a scan driver 201, the emission driver 300, the data driver 400, and a timing controller 501.

The scan driver 201 may include first and second scan drivers 220 and 240.

The first scan driver 220 may receive a first scan control signal SCS1 from the timing controller 501, and supply a first scan signal to first scan lines SL1, based on the first scan control signal SCS1.

The second scan driver 240 may receive a second scan control signal SCS2 from the timing controller 501, and supply a second scan signal to second scan lines SL2, based on the second scan control signal SCS2.

In an exemplary embodiment of the inventive concept, as shown in FIG. 5, widths of the first scan signal S1_*i* and the second signal S2_*i* may be different from each other. Therefore, the display device 1001 may include the first and second scan drivers 220 and 240 for outputting scan signals having different widths.

The width of the second scan signal for initialization and threshold voltage compensation may be wider than that of the first scan signal for data writing. In one frame period, the first scan signal may be supplied to the pixel PX after the second scan signal is supplied to the pixel PX.

Accordingly, the pixel PX can emit light according to a corresponding data voltage, without influence of a data voltage corresponding to another pixel.

Figure 7:
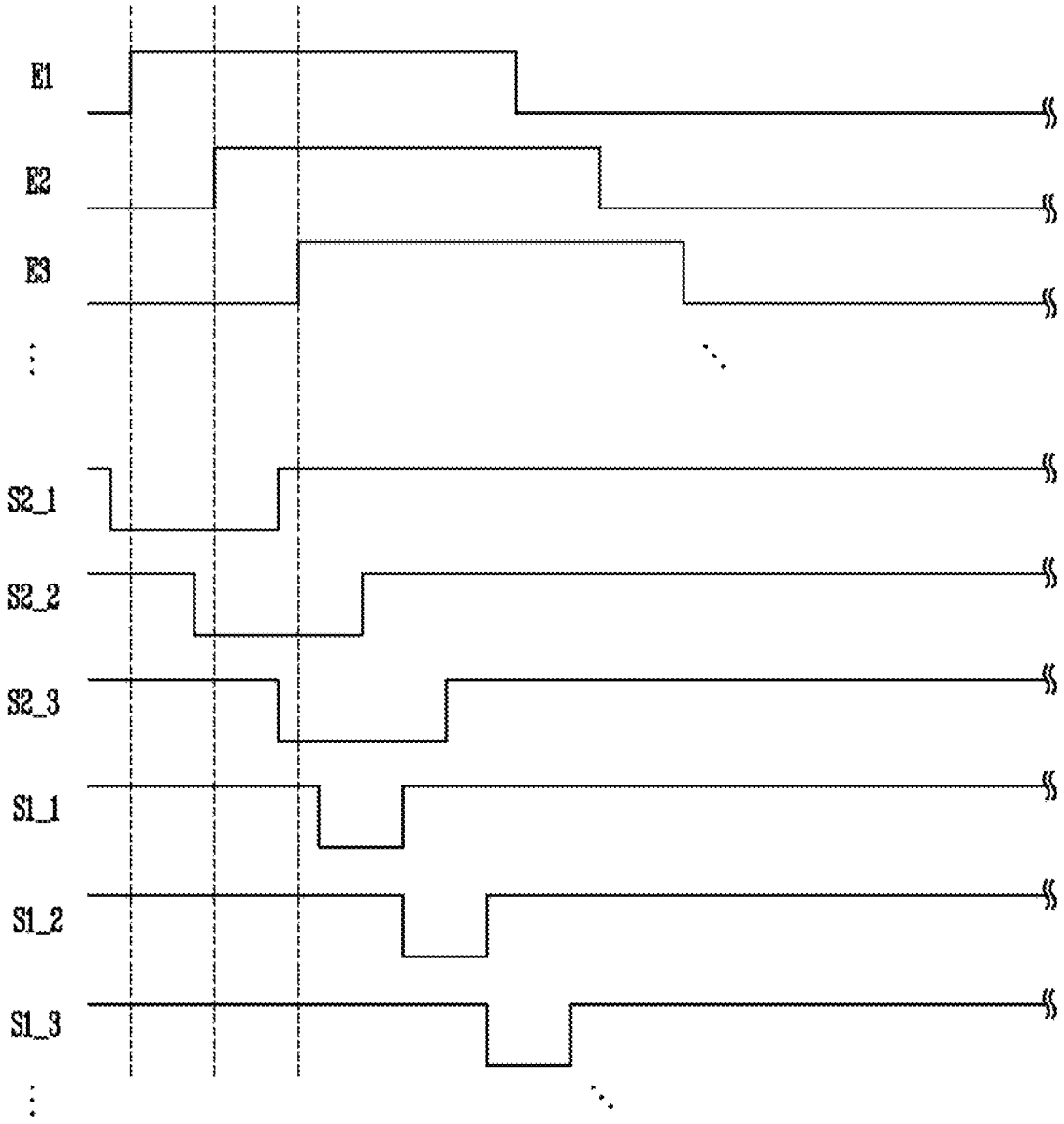
FIG. 7 is a timing diagram illustrating an operation of the display device shown in FIG. 6 according to an exemplary embodiment of the inventive concept.

FIG. 7 is a timing diagram illustrating an operation of the display device shown in FIG. 6 according to an exemplary embodiment of the inventive concept.

In FIG. 7, components identical to those described with reference to FIG. 4 are designated by like reference numerals, and their overlapping descriptions will be omitted. In addition, the timing diagram shown in FIG. 7 may be substantially identical or similar to the operation of the display device, which is shown in FIG. 4, except for a width (pulse width) of first scan signals S1_1, S1_2, and S1_3.

Referring to FIGS. 2, 6, and 7, emission control signals E1, E2, and E3, first scan signals S1_1, S1_2, and S1_3, and second scan signals S2_1, S2_2, and S2_3 may be sequentially supplied to pixel rows.

The first first scan signal S1_1 and the first second scan signal S2_1 do not overlap with each other. In addition, the second first scan signal S1_2 and the second second scan signal S2_2 do not overlap with each other. Similarly, the third first scan signal S1_3 and the third second scan signal S2_3 do not overlap with each other.

In an exemplary embodiment of the inventive concept, the second scan signals S2_1, S2_2, and S2_3 may respectively overlap with portions of emission periods of the emission control signals E1, E2, and E3. For example, a portion of the first second scan signal S2_1 may overlap with a portion of the period in which the first emission control signal E1 has the gate-on level.

In an exemplary embodiment of the inventive concept, a width of the first scan signals S1_1, S1_2, and S1_3 may be narrower than that of the second scan signals S2_1, S2_2, and S2_3. For example, the width of the first scan signals S1_1, S1_2, and S1_3 may be half of the width of the second scan signals S2_1, S2_2, and S2_3.

Accordingly, a threshold voltage compensation period can be sufficiently secured, and only a data voltage corresponding to a pixel is supplied to the corresponding pixel in a data writing period, so that unnecessary voltage fluctuation of the first transistor T1 can be prevented. Thus, image quality of a high-resolution display device, a large-sized display device, a stereoscopic image display device, or the like, which require high-speed driving, can be improved.

Figure 8:
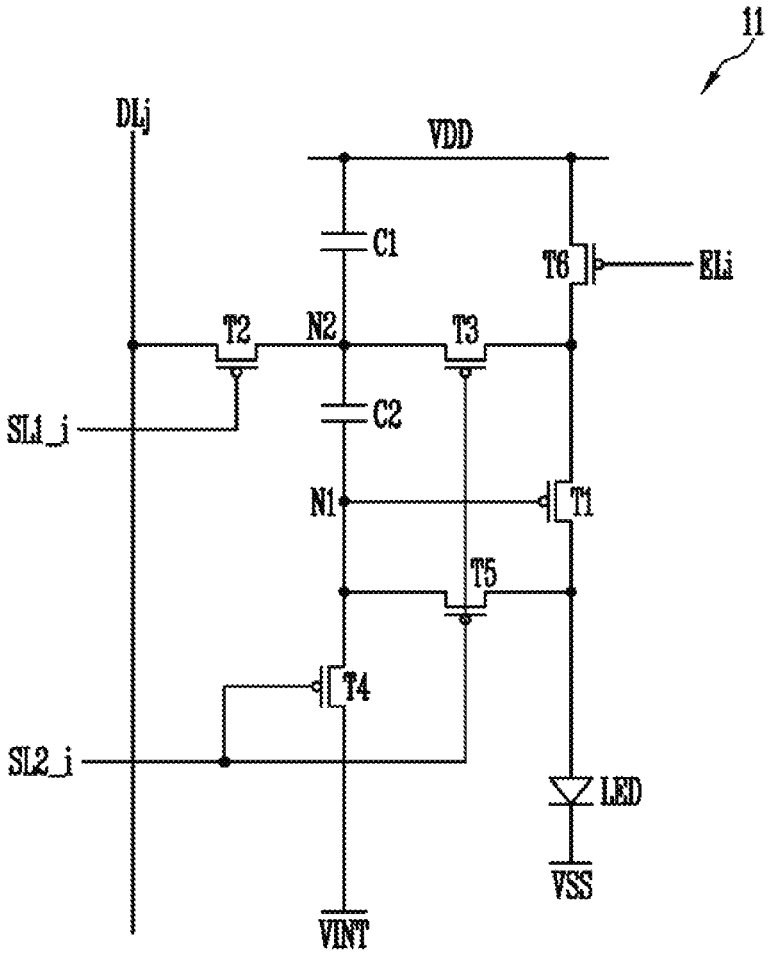
FIG. 8 is a circuit diagram illustrating a pixel according to an exemplary embodiment of the inventive concept.

FIG. 8 is a circuit diagram illustrating a pixel according to an exemplary embodiment of the inventive concept.

In FIG. 8, components identical to those described with reference to FIG. 2 are designated by like reference numerals, and their overlapping descriptions will be omitted. In addition, the pixel shown in FIG. 8 may be substantially identical or similar to the pixel shown in FIG. 2, except for the arrangement of fourth and fifth transistors.

Referring to FIG. 8, a pixel 11 may include the light emitting device LED, the first to sixth transistors T1 to T6, the first capacitor C1, and the second capacitor C2.

Configurations of the first to third transistors T1 to T3, the sixth transistor T6, the first capacitor C1, and the second capacitor C2 have been described with reference to FIG. 2, and therefore, overlapping descriptions will be omitted.

The fourth transistor T4 may be coupled between the first node N1 and the third power source VINT. A gate electrode of the fourth transistor T4 may be coupled to the second scan line SL2_*i*. The fourth transistor T4 may be turned on when a scan signal is supplied to the second scan line SL2_*i*, to supply a voltage of the third power source VINT to the first node N1.

The fifth transistor T5 may be coupled between a second electrode of the first transistor T1 (and a first electrode of the light emitting device LED) and the first node N1. A gate electrode of the fifth transistor T5 may be coupled to the second scan line SL2_*i*. The fifth transistor T5 may be turned on when a scan signal is supplied to the second scan line SL2_*i*, to supply the voltage of the third power source VINT to the first electrode of the light emitting device LED. Therefore, a voltage of the first electrode of the light emitting device LED may be initialized.

When the third to fifth transistors T3 to T5 are turned on and the sixth transistor T6 is turned off, the first transistor T1 operates in a source follower structure, so that a threshold voltage of the first transistor T1 can be compensated.

The pixel 10 shown in FIG. 2 may be modified to the pixel structure shown in FIG. 8 according to an arrangement configuration of the transistors and an arrangement relationship with other lines.

Figure 9:
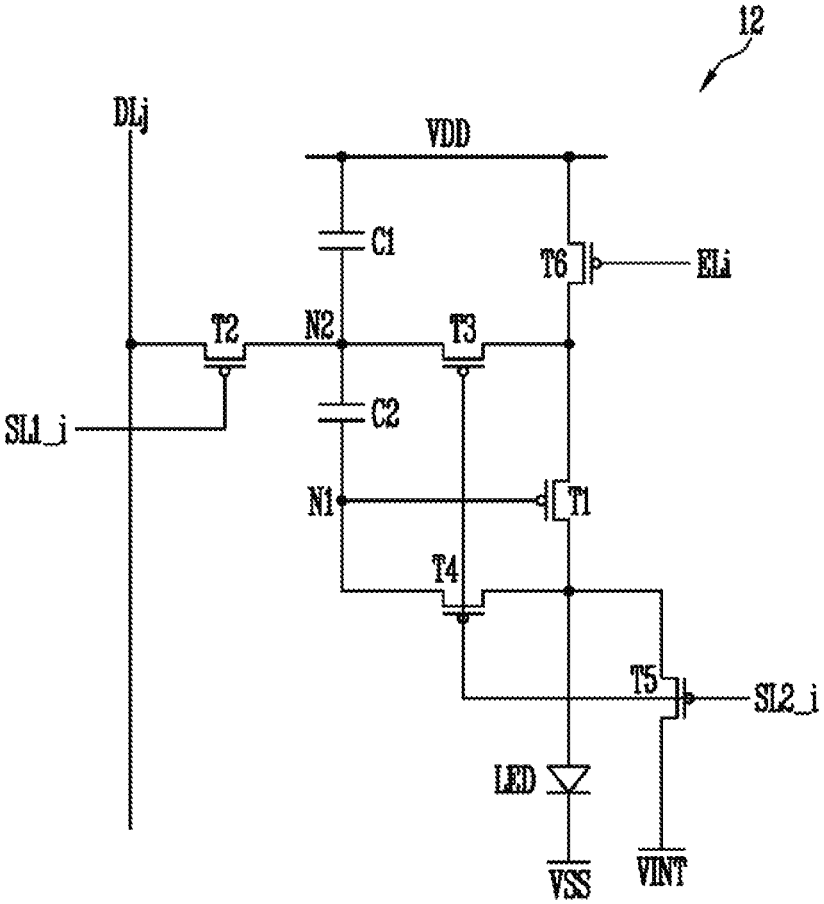
FIG. 9 is a circuit diagram illustrating a pixel according to an exemplary embodiment of the inventive concept.

FIG. 9 is a circuit diagram illustrating a pixel according to an exemplary embodiment of the inventive concept.

In FIG. 9, components identical to those described with reference to FIG. 2 are designated by like reference numerals, and their overlapping descriptions will be omitted. In addition, the pixel shown in FIG. 9 may be substantially identical or similar to the pixel shown in FIG. 2, except for the arrangement of fourth and fifth transistors.

Referring to FIG. 9, a pixel 12 may include the light emitting device LED, the first to sixth transistors T1 to T6, the first capacitor C1, and the second capacitor C2.

The fourth transistor T4 may be coupled between the first node N1 and a second electrode of the first transistor T1. A gate electrode of the fourth transistor T4 may be coupled to the second scan line SL2_*i*. The fourth transistor T4 may be turned on when a scan signal is supplied to the second scan line SL2_*i*, to supply a voltage of the third power source VINT to the first node N1.

The fifth transistor T5 may be coupled between the second electrode of the first transistor T1 (and a first electrode of the light emitting device LED) and the third power source VINT. A gate electrode of the fifth transistor T5 may be coupled to the second scan line SL2_*i*. The fifth transistor T5 may be turned on when a scan signal is supplied to the second scan line SL2_*i*, to supply the voltage of the third power source VINT to the first electrode of the light emitting device LED. Therefore, a voltage of the first electrode of the light emitting device LED may be initialized.

When the third to fifth transistors T3 to T5 are turned on, only one current path may be formed from the first node N1 to the third power source VINT. Thus, an unintended change in driving current due to current leakage can be prevented.

As described above, in the pixel and the display device having the same according to an exemplary embodiment of the inventive concept, the threshold voltage of the first transistor can be compensated using the source follower structure. In addition, a threshold voltage compensation operation corresponding to the scan signal supplied to the second scan line and a data writing operation corresponding to the scan signal supplied to the first scan line can be separated from each other. Thus, a time for threshold voltage compensation of the display device, to which high-speed driving is applied, can be sufficiently secured, and image quality can be improved. In addition, image quality of a high-resolution display device, a large-sized display device, a stereoscopic image display device, or the like, which require high-speed driving, can be improved.

Further, the pixel is driven using a minimum number of power sources and signals, so that manufacturing cost of the display device can be reduced.

While the inventive concept has been shown and described with reference to exemplary embodiments thereof, it will be understood by those of ordinary skill in the art that various changes in form and details may be made thereto without departing from the spirit and scope of the inventive concept as set forth in the following claims.

What is claimed is:

1. A pixel comprising:

a light emitting device;

a first transistor configured to control an amount of current flowing from a first power source to a second power source via the light emitting device, corresponding to a voltage applied to a first node;

a second transistor coupled between a data line and a second node, and including a gate electrode coupled to a first scan line;

a third transistor coupled between the second node and a first electrode of the first transistor, and including a gate electrode coupled to a second scan line;

a first capacitor coupled between the first power source and the second node;

a second capacitor coupled between the first node and the second node;

a fourth transistor coupled between the first node and a third power source, and including a gate electrode coupled to the second scan line; and a fifth transistor coupled between a second electrode of the first transistor and the third power source, and including a gate electrode coupled to the second scan line.

2. The pixel of claim 1, further comprising:

a sixth transistor coupled between the first power source and the first electrode of the first transistor, and including a gate electrode coupled to an emission control line.

3. The pixel of claim 2, wherein the sixth transistor is turned off after the third to fifth transistors are turned on.

4. The pixel of claim 2, wherein a first time at which a scan signal supplied to the second scan line is changed from a gate-off level to a gate-on level is earlier than a second time at which an emission control signal supplied to the emission control line is changed from the gate-on level to the gate-off level.

5. The pixel of claim 4, wherein a portion of the gate-on level of the scan signal supplied to the second scan line overlaps with a period in which the emission control signal has the gate-on level.

6. The pixel of claim 3, wherein a width of a gate-on level of the scan signal supplied to the second scan line is wider than that of a scan signal supplied to the first scan line.

7. The pixel of claim 2, wherein the third to fifth transistors are turned on by a scan signal supplied to the second scan line, and the first transistor is coupled in a source follower state.

8. The pixel of claim 2, wherein, when the third to fifth transistors are turned on by a scan signal supplied to the second scan line, a voltage corresponding to a threshold voltage of the first transistor is stored in the second capacitor.

9. A pixel comprising:

a light emitting device;

a first transistor configured to control an amount of current flowing from a first power source to a second power source via the light emitting device, corresponding to a voltage applied to a first node;

a second transistor coupled between a data line and a second node, and including a gate electrode coupled to a first scan line;

a third transistor coupled between the second node and a first electrode of the first transistor, and including a gate electrode coupled to a second scan line;

a first capacitor coupled between the first power source and the second node; and a second capacitor coupled between the first node and the second node;

a fourth transistor coupled between the first node and a third power source, and including a gate electrode coupled to the second scan line;

a fifth transistor coupled between a second electrode of the first transistor and the first node, and including a gate electrode coupled to the second scan line; and a sixth transistor coupled between the first power source and the first electrode of the first transistor, and including a gate electrode coupled to an emission control line.

10. A pixel comprising:

a light emitting device;

a first transistor configured to control an amount of current flowing from a first power source to a second power source via the light emitting device, corresponding to a voltage applied to a first node;

a second transistor coupled between a data line and a second node, and including a gate electrode coupled to a first scan line;

a third transistor coupled between the second node and a first electrode of the first transistor, and including a gate electrode coupled to a second scan line;

a first capacitor coupled between the first power source and the second node; and a second capacitor coupled between the first node and the second node;

a fourth transistor coupled between the first node and a second electrode of the first transistor, and including a gate electrode coupled to the second scan line;

a fifth transistor coupled between the second electrode of the first transistor and a third power source, and including a gate electrode coupled to the second scan line; and a sixth transistor coupled between the first power source and the first electrode of the first transistor, and including a gate electrode coupled to an emission control line.

11. A display device comprising:

a display panel including a plurality of pixels;

a scan driver configured to supply a scan signal to the plurality of pixels through scan lines;

an emission driver configured to supply an emission control signal to the plurality of pixels through emission control lines; and a data driver configured to supply a data signal to the plurality of pixels through data lines, wherein a first pixel disposed on an ith (where i is a natural number) pixel row among the plurality of pixels comprises:

a light emitting device;

a first transistor configured to control an amount of current flowing from a first power source to a second power source via the light emitting device, corresponding to a voltage applied to a first node;

a second transistor coupled between a data line and a second node, and including a gate electrode coupled to a first scan line of the ith pixel row;

a third transistor coupled between the second node and a first electrode of the first transistor, and including a gate electrode coupled to a second scan line of the ith pixel row;

a first capacitor coupled between the first power source and the second node;

a second capacitor coupled between the first node and the second node;

a fourth transistor coupled between the first node and a third power source, and including a gate electrode coupled to the second scan line; and a fifth transistor coupled between a second electrode of the first transistor and the third power source, and including a gate electrode coupled to the second scan line.

12. The display device of claim 11, wherein the first pixel further comprises:

a sixth transistor coupled between the first power source and the first electrode of the first transistor, and including a gate electrode coupled to an emission control line of the ith pixel row.

13. The display device of claim 12, wherein the third to fifth transistors are turned on by a scan signal supplied to the second scan line, and the first transistor is coupled in a source follower state.

14. The display device of claim 12, wherein the sixth transistor is turned off after the third to fifth transistors are turned on.

15. The display device of claim 12, wherein the scan driver supplies the scan signal to the second scan line such that a portion of a gate-on level of the scan signal supplied to the second scan line overlaps with a period in which the emission control signal supplied to the emission control line of the ith pixel row has a gate-on level.

16. The display device of claim 15, wherein the scan driver comprises:

a first scan driver configured to supply a first scan signal to the first scan line; and a second scan driver configured to supply a second scan signal to the second scan line.

17. The display device of claim 16, wherein a width of a gate-on level of the second scan signal is wider than that of the first scan signal.

18. The display device of claim 16, wherein the first scan driver outputs a gate-on level of the first scan signal after the second scan driver outputs a gate-on level of the second scan signal, and the gate-on level of the first scan signal and the gate-on level of the second scan signal do not overlap with each other.

* * * * *